United States Patent [19]

Puccio

[11] 4,018,539

[45] * Apr. 19, 1977

[54] MODULAR ELASTOMERIC EXPANSION SEAL

[75] Inventor: Guy S. Puccio, Lancaster, N.Y.

[73] Assignee: Acme Highway Products Corporation, Buffalo, N.Y.

[ * ] Notice: The portion of the term of this patent subsequent to Nov. 30, 1993, has been disclaimed.

[22] Filed: Dec. 5, 1975

[21] Appl. No.: 638,200

[52] U.S. Cl. ..... 404/69

[51] Int. Cl.² ..... E01C 11/02

[58] Field of Search ..... 404/68, 69, 67, 65, 404/64, 48, 47; 52/396

[56] References Cited

UNITED STATES PATENTS

| | | | |
|---|---|---|---|
| 3,387,544 | 6/1968 | MacLellan | 404/68 X |
| 3,595,142 | 7/1971 | Via | 404/64 X |
| 3,606,826 | 9/1971 | Bowman | 404/67 X |
| 3,626,822 | 12/1971 | Koster | 404/69 |
| 3,682,053 | 8/1972 | Kershner | 404/65 |
| 3,722,379 | 3/1973 | Koster | 404/68 |
| 3,765,784 | 10/1973 | Watson | 404/64 |
| 3,776,654 | 12/1973 | Brown | 404/65 |
| 3,888,599 | 6/1975 | Reifsnyder | 404/69 |

*Primary Examiner*—Nile C. Byers, Jr.
*Attorney, Agent, or Firm*—Christel & Bean

[57] ABSTRACT

A modular expansion seal for use in roadways, bridges, and the like adapted for use with a pair of elongated, parallel, spaced-apart retaining members defining a gap therebetween and each of the retaining members having a generally C-shaped cavity opening towards said gap. The seal includes end walls for mounting within the aforesaid retaining member cavities and top and bottom walls extending between the end walls for spanning the aforesaid gap. Each end wall includes an outer surface configuration generally adapted for matching engagement with said cavity. However, the radius of curvature of the end wall in an unstressed, disassembled condition is less than the radius of curvature of the cavity so that upon assembly of the end wall within the cavity the outer curved wall position is forced to assume the curvature of the cavity resulting in a highly effective mounting of the end wall therein. In addition, support members extend between the midportion of each end wall and the top and bottom walls adjacent to the respective retaining member for enhancing the retention or mounting of each end wall therein.

10 Claims, 7 Drawing Figures

MODULAR ELASTOMERIC EXPANSION SEAL

BACKGROUND OF THE INVENTION

This invention relates generally to expansion joint seals of the type used for sealing an expansion joint space or gap against the intrusion of dirt, water and other debris as for example might be encountered by expansion joints employed in roadway construction. More specifically, the present invention relates to a modular elastomeric expansion seal which may be employed in a joint assembly having elongated, metal retaining members of I-beams installed parallel to one another between a pair of structural members such as concrete slabs wherein the seal of the present invention is connected between spaced, adjacent retaining members.

One problem encountered with many available expansion joint seals is that the retaining or mounting bead portions become dislodged from one of the retaining members over part or all of the longitudinal lengths of the joint with the result that the seal no longer remains watertight and thus ceases to perform one of the principal functions for which it was provided.

There have been various proposals for design of the seal mounting means which have had the objective of minimizing the possibility of failure of the joint by dislodging of the seal from the retaining members of the assembly. In regard to expansion seals having mounting beads formed along the longitudinal edges thereof for mounting in a corresponding cavity of retaining members, a number of specific problems have been encountered. It has been found very difficult in the prior art to form metal retaining members having a cavity therein of predetermined cross section which includes any degree of relatively high tolerance along the entire extruded length thereof. For example in extruding a metal retaining member with a cavity therein on the order of 16 feet in longitudinal length, as might be utilized in a road joint, it has been found that the extrusion process fails to maintain uniformity in the cross sectional dimensions of the cavity along the entire longitudinal length thereof. On the other hand, it has been found possible in the prior art to maintain a relatively high degree of tolerance with respect to the outer surface cross-sectional dimension of an extruded expansion seal. Necessarily, the resultant differences in uniformity between the aforesaid retaining member cavity and associated portion of a seal result in the possibility of the seal being easily dislodged from the retaining member. In U.S. patent application Ser. No. 629,517 filed Nov. 6, 1975 by Guy S. Puccio and assigned to the same assignee as the instant application, the above difficulties with respect to the prior art were overcome with respect to a strip seal as disclosed and claimed in said prior application. Similarly, the instant application discloses and claims a seal overcoming the above problems and drawbacks of the prior art wherein such seal is of tubular or modular construction.

SUMMARY OF THE INVENTION

Accordingly, one object of the present invention is to provide a new and improved modular elastomeric expansion seal having end walls along the longitudinal edges thereof for insertion into the respective cavities of associated retaining members I-beams wherein each end wall is affirmatively retained in flush engagement with the cavity wall so as to resist the intrusion of water and other debris.

Another object of the present invention is to provide a modular elastomeric seal wherein the end wall may be easily inserted into the cavity of a retaining member and be effectively retained therein in the presence of limited nonuniformity in the cavity configuration as resulting from the manufacture of the retaining member.

Still another object of the present invention provides a modular expansion joint seal wherein lateral dislodgement of the end walls thereof from the associated retaining member cavity is resisted during the various degrees of expansion and contraction of the structural members associated with the joint.

In summary, the present invention provides a modular elastomeric seal for an expansion joint having vertically spaced top and bottom walls for spanning an expansion gap defined by a pair of spaced retaining members or I-beams. The seal includes opposite end walls connected to the corresponding longitudinal edges of the top and bottom walls. Each of the end walls is adapted for insertion into a C-shaped cavity of preselected curvature formed in a retaining member. The C-shaped cavity opens towards the adjacent expansion gap and included opposed projecting portions defining an opening therebetween. Each end wall of the seal in an assembled condition includes a vertical dimension nominally equal to the vertical dimension of the retaining member cavity. In addition, each end wall includes a curved outer surface portion when in a disassembled condition having a radius of curvature less than the corresponding cavity wall of a retaining member. Upon insertion of the end wall into the cavity the upper and lower portions of the end wall laterally abut the spaced portions of the retaining member defining the cavity opening and the curved outer surface of the end wall is affirmatively forced to assume the curvature of the cavity wall.

The seal further includes two support members extending from the midportion of each end wall to the respectively adjacent top and bottom wall portions at a lateral location adjacent to the outer edge of the respectively associated retaining member. The support members function to provide resiliency to the operation of the top and bottom walls while further serving to enhance the locking of the end wall within the retaining member.

The foregoing and other objects, advantages and characterizing features of the present invention will become clearly apparent from the ensuing detailed description of an illustrative embodiment thereof taken together with the accompanying drawings wherein like reference characters denote like parts throughout the various views.

DETAILED DESCRIPTION OF A PREFERRED EMBODIMENT

Figure 1:
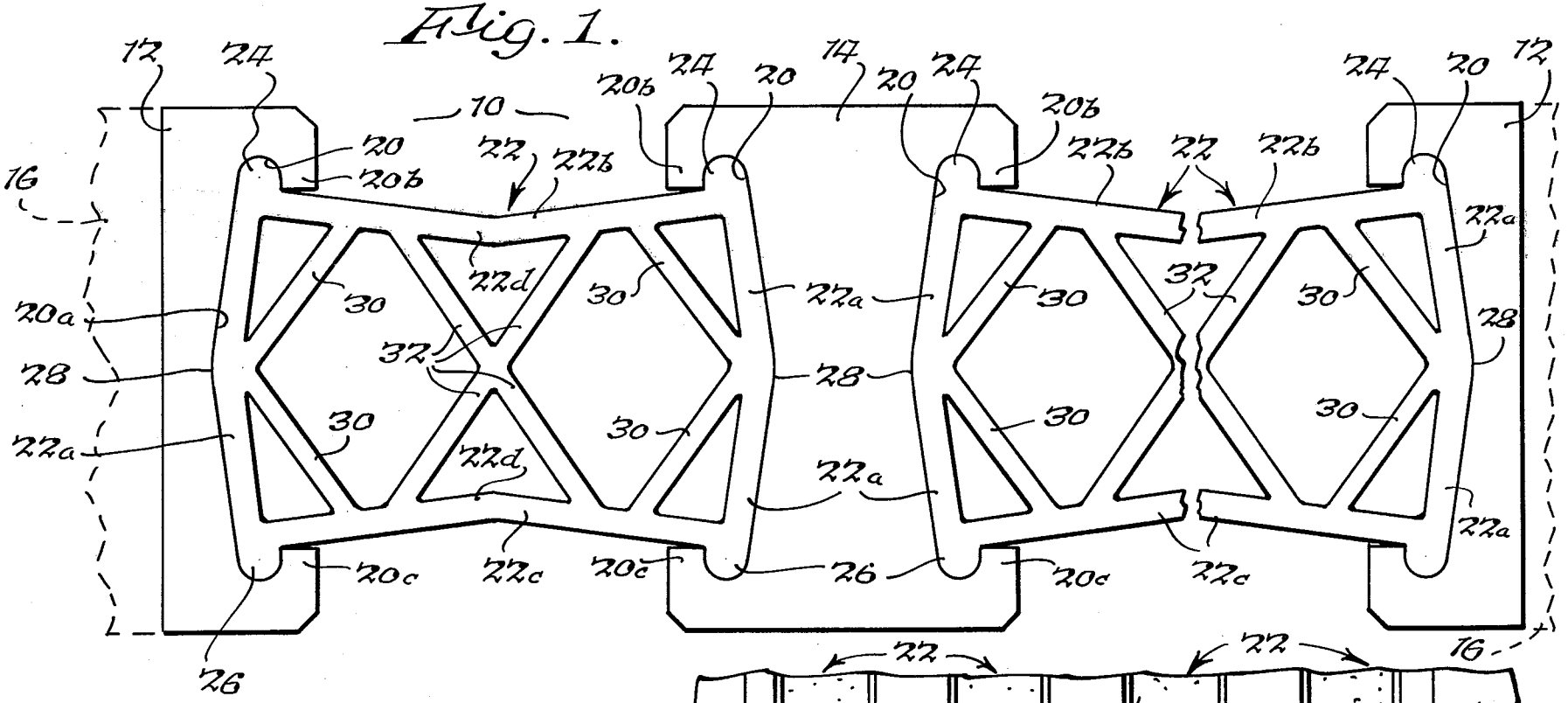
FIG. 1 is a vertical sectional view of an expansion joint according to the invention bridging the gaps between spaced pairs of retaining members.
Figure 2:
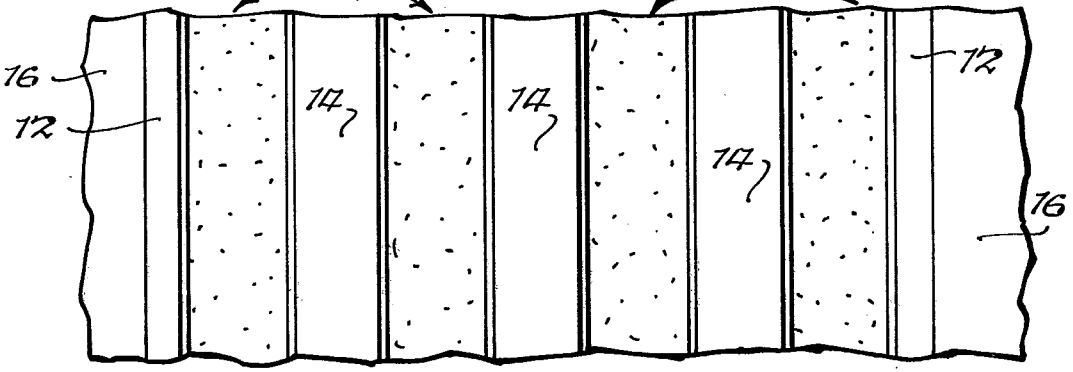
FIG. 2 is a fragmentary, top plan view of a plurality of modular seals and spaced retaining members assembled one to another.
Figures 3, 4, 5:
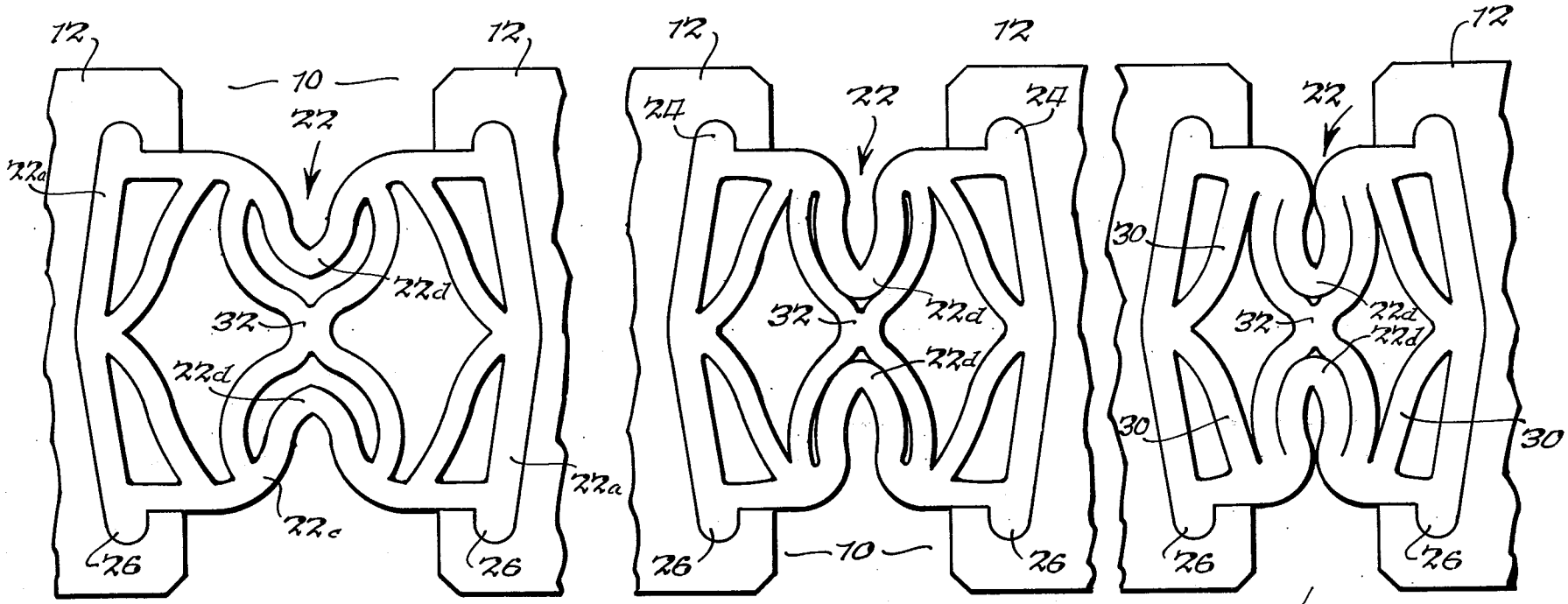
FIG. 3 is a fragmentary, vertical sectional view similar to FIG. 1 showing the seal of the present invention in a partially compressed condition.
FIG. 4 is a view similar to FIGS. 1 and 3 showing the seal of the present invention in a relatively greater compressed condition.
FIG. 5 is a view similar to FIGS. 1, 3 and 4 showing the seal of the present invention in a fully compressed condition.

Referring in detail to the illustrative embodiment depicted in the accompanying drawings, there is shown in FIG. 1 a modular expansion joint seal for bridging the gap 10 between a pair of metallic retaining members 12 and 14 as might be found in roadway and bridge construction. As shown, a retaining member 12 may be so formed as to be embedded or permanently affixed to the structural slab member 16 as is well known in the prior art whereby it is to be understood that reference to retaining members includes those such as 12 and retaining members or I-beams such as 14 which are designed to be placed between retaining members such as 12.

Figure 6:
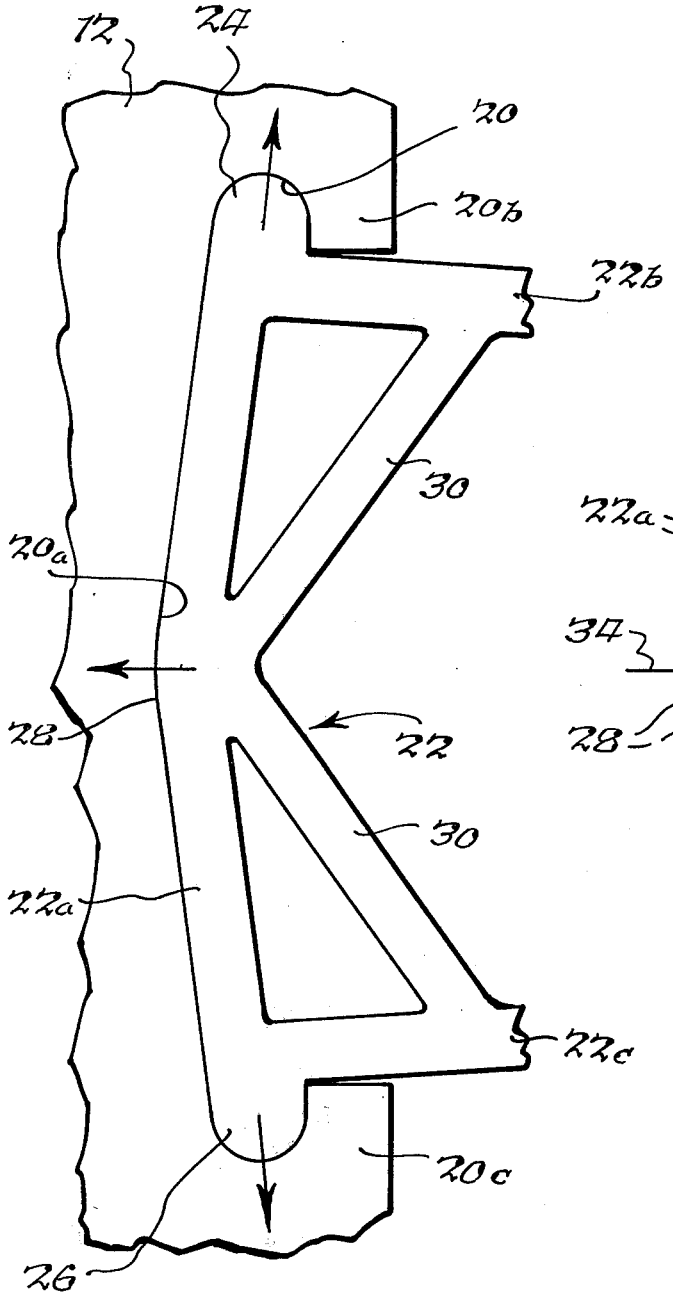
FIG. 6 is a fragmentary, vertical sectional view showing in detail an end wall of the modular seal fully inserted within a retaining member cavity.

As shown most clearly in FIGS. 1 and 6, each of the retaining members includes a C-shaped cavity 20 having a preselected radius of curvature wherein each of the cavities open toward the gap 10 as defined between adjacent retaining members. As shown in the above drawings, the cavities 20 are formed to include linear surface portions in addition to the curvilinear portion most notably seen at the midportion 20*a* of the cavity. In this regard therefore, the term "preselected radius" of the cavity is intended to refer to the relatively wide angular separation between the upper and lower portions of cavity 20 as including the midportion 20*a*, all of which is analagous to an arc of preselected radius.

As further seen in FIGS. 1 and 6, each cavity opening is defined between opposed projecting portions of the retaining member as indicated at 20*b* and 20*c* and which are spaced from each other a distance less than the maximum dimension within the cavity as taken generally parallel to the cavity opening. In other words, the cavity opening is less than the vertical height of the cavity as seen in FIGS. 1 and 6.

In FIG. 1, an elongated modular elastomeric sealing member 22 is shown in transverse cross section for assembly with the retaining member cavities for sealing the gap 10. The sealing member 22 includes end walls 22*a* extending along and connecting the corresponding longitudinal edges of top wall 22*b* and bottom wall 22*c*. The top and bottom walls span the gap 10 and each include a longitudinally extending fold 22*d* located substantially along the centerline of the gap 10 which fold towards one another in a manner corresponding to the degree of contraction in the width of the gap 10.

Figure 7:
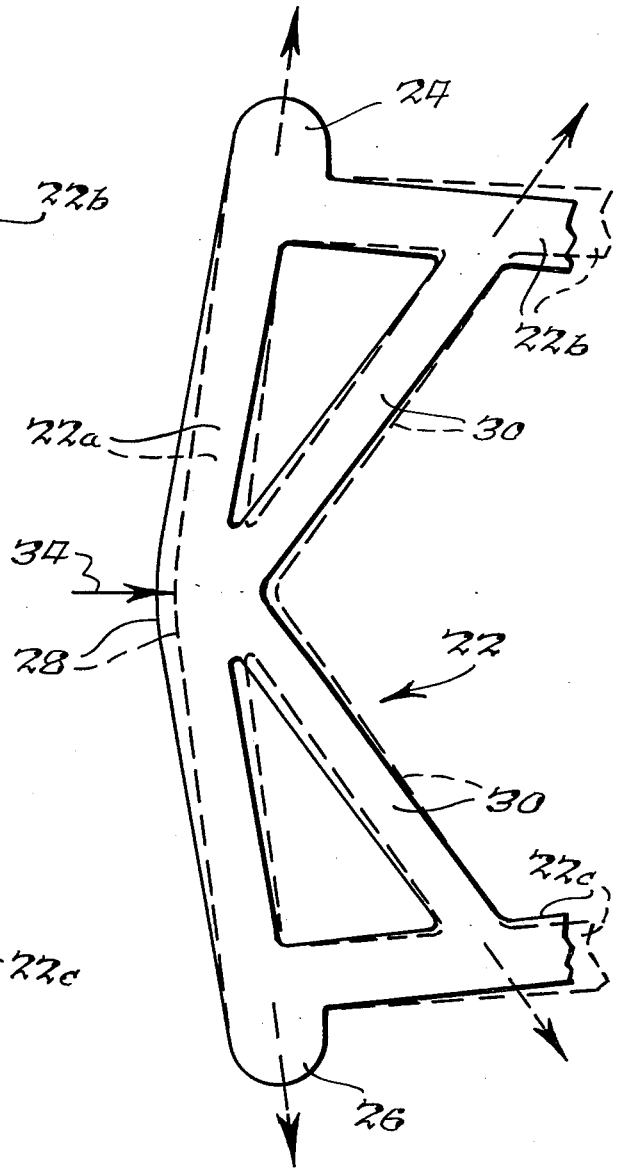
FIG. 7 illustrates in dotted line form the cross sectional configuration of a seal end wall in a mounted condition as opposed to the solid line cross sectional configuration of the end wall in an unstressed, disassembled condition.

Each of the end walls 22*a* includes in cross section an outer curved surface portion for matching engagement with the encompassing wall surface of cavity 20 when in assembled position therewith. The upper and lower opposed portions 24 and 26 of the end wall are provided to correspondingly abut the opposed projecting portions 20*b* and 20*c* of the retaining member whereby lateral movement of the end wall towards gap 10 is resisted as is apparent from FIGS. 1 and 6. As will be more fully described hereinbelow, the curved outer surface, as it is referred to, of the end wall 22*a* actually includes linear upper and lower portions disposed at an angle with respect to one another and are connected by an intermediate curved portion 28. As discussed with respect to such similar structure of the retaining member cavity the degree of curvature of the outer surface of the end wall is intended to refer to the degree of angular separation between the upper and lower portions of the end wall as including the intermediate curved portion 28. In the analagous sense, therefore, the end walls would be deemed to have a larger radius of curvature in those instances where the upper and lower portions of the end wall have a relatively greater angular separation. Accordingly, the outer wall surface of end wall 22*a* is provided with a preselected radius of curvature which is less than the analagous radius of curvature of the corresponding wall portion in cavity 20. As is apparent from FIG. 7, the configuration of end wall 22*a* in an unstressed, disassembled position would appear as that shown in solid line while after assembly within cavity 20, the end wall would assume the contour shown in dotted line form.

As further seen in FIG. 1, support members 30 are provided to extend between the midportion of each end wall 22*a* and the correspondingly adjacent top and bottom walls 22*b* and 22*c*. The support members necessarily extend at an angle with respect to the top and bottom walls and intersect the same at locations laterally adjacent to the outer surfaces of the retaining members defining the gap 10. In addition, the central portion of the seal member 22 includes an X-shaped truss 32 extending between the top and bottom walls 22*b* and 22*c* intermediate to the intersection of the support members 30 therewith.

In describing the operation of the seal and in particular the mounting of the end walls therein, consideration will first be given to the static characteristics of each end wall 22*a* in an assembled position and then consideration will be given to the dynamic characteristics of the end wall during expansion and contraction of the structural slab members 16 and necessarily the expansion gaps 10 formed between the several retaining members. As described hereinabove, the radius of curvature, as that term has been defined, of the outer surface of end wall 22*a* prior to assembly is less than the radius of curvature of the corresponding wall portion of cavity 20. The projections 24 and 26 and the intermediate portion of end wall 22*a* may be flexed so as to insert the end wall into cavity 20. In this manner, the locking of the upper and lower portions 24 and 26 of the end wall behind projections 20*b* and 20*c* of the retaining member cavity will affirmatively force the curved mid-portion 28 of the end wall to assume the curvature of the adjacent cavity wall as clearly indicated in dotted line manner in FIG. 7. As is also apparent from FIG. 7, the cavity wall will be in firm engagement in a reaction sense with the end wall as indicated by the vector 34. Such a modification of the curvature of the end wall tends to induce the projections 24 and 26 to separate from one another. However, when the nominal vertical height of the end wall in a disassembled position as including the projections 24 and 26 is generally equal to the vertical heights of cavity 20, the end wall 22*a* becomes only more firmly locked within cavity 20 as the upper and lower projections thereon are forced into a tighter engagement with the adjacent portions of the cavity as the curvature of the wall is modified by its engagement with the adjacent cavity wall.

As shown by the force vectors in FIG. 6, the outer surface of the end wall will necessarily develop reaction forces to firmly engage the cavity wall. It therefore can be understood that the insertion of the end wall 22*a* within cavity 20 develops a locking pressure therein by the modification of the curvature of the end wall and that any variations in the cross sectional configuration of the cavity 20 will be compensated for by such locking pressure developed within the cavity whereby the end wall tends to positively engage such surrounding cavity wall.

In a static sense it can also be seen that the support members 30 and an X-shaped truss 32 provide vertical resilience to the top and bottom walls by the connection of said elements thereto. In a dynamic sense, the sealing member 22 assumes the configurations shown sequentially in FIGS. 1 and 3–5 for various degrees of contraction of the gap 10. As the gap 10 narrows in width, each of the supporting members 30 tends to buckle but only after positively forcing the connected top or bottom wall portions as the case may be against the horizontal surface of the retaining member projections 20*b* or 20*c* respectively. Such operation insures that the projections 24 and 26 on the end wall will be firmly maintained in position behind the projections 20*b* and 20*c* on the retaining member. In addition, the ends of the support members connected to the midportion of the end walls 22*a* exert force thereon insuring that such end wall does not buckle inwardly toward the gap whereby the static locking forces referred to hereinabove with respect to the retention of the end wall in cavity 20 are maintained. Furthermore, the positioning of the X-shaped truss 32, in addition to providing vertical resilience to the top and bottom walls, allows for the inward folding of portions 22*d* thereon commensurate with the degree of contraction in the width of the groove 10.

From the foregoing, it is apparent that the objects of the present invention have been fully accomplished. As a result of this invention, an improved modular elastomeric expansion seal has been provided to have end walls which are firmly locked in associated cavities of retaining members in a joint structure. Static locking of the end walls is primarily made more effective by the affirmative change in curvature of the outer surface portion thereof by their engagement with the respectively associated cavity wall portions while dynamic locking of the end walls is made more effective by the attachment of support members 30 between the end walls and the portions of the correspondingly adjacent top and bottom walls at lateral locations adjacent to the side surfaces of the retaining members defining gap 10.

Having thus described and illustrated a preferred embodiment of the invention, it will be understood that such description and illustration is by way of example only and such modifications and changes as may suggest themselves to those skilled in the art are intended to fall within the scope of the present invention as limited only by the appended claims.

I claim:

1. A sealing member for use in an expansion joint having at least one pair of spaced-apart, elongated retaining members defining a gap therebetween, each said retaining member having in cross-section a generally C-shaped cavity with a preselected radius of curvature, each said cavity opening toward said gap defined between said retaining members wherein each said cavity opening is defined between opposed projecting portions of said respective retaining member, said portions being spaced from each other a distance less than the maximum dimension within said cavity taken generally parallel to said opening, said sealing member comprising:

a top and bottom wall spanning said gap and a pair of end walls, each said end wall disposed along and interconnecting corresponding longitudinal edges of said top and bottom walls wherein each of said end walls is received within said cavity of a respective retaining member, and each of said end walls having in cross-section an outer surface portion for matching engagement with said cavity with opposed portions of each said end wall correspondingly abutting said opposed projecting portions of said retaining member whereby relative lateral movement of each said end wall with respect to said retaining member is resisted, and the radius of curvature of the outer surface of each said end wall in an unstressed, disassembled form beingless than said preselected radius of curvature of said cavity so that upon assembly of each said end wall within said respective retaining member cavity said outer surface of each said end wall is affirmatively urged to assume the relatively greater radius of curvature of said cavity by the abutment of said opposed portions of each said end wall with said opposed projecting portions of said respective retaining member.

2. A sealing member as set forth in claim 1 wherein the nominal dimension of each said end wall in disassembled condition, which corresponds to said maximum dimension within said respective retaining member cavity taken generally parallel to said respective opening is substantially equal thereto, so that upon assembly of each said end wall within each said respective cavity, each said end wall develops a locking pressure therein.

3. A sealing member as set forth in claim 1 further including support members extending between said end walls and said top and bottom walls at angles relative thereto so that movement of said top and bottom walls resulting from expansion and contraction of said joint induces said opposed portions of each said end wall to separate one from the other.

4. A sealing member as set forth in claim 3 wherein two support members are connected to each of said end walls at the midportion thereof and extend to said top and bottom walls for respective connection therewith at locations adjacent to said respective retaining member.

5. A sealing member as set forth in claim 4 wherein said top and bottom walls each include a longitudinally extending fold located substantially along the center line of said gap defined between said retaining members with said folds extending towards one another.

6. A sealing member as set forth in claim 5 further including an X-shaped truss extending between said top and bottom walls intermediate to the connections of said support members therewith and being symmetrically disposed about the center line of said gap defined between said retaining members.

7. A sealing member as set forth in claim 2 further including support members extending between said end walls and said top and bottom walls at angles relative thereto so that movement of said top and bottom walls resulting from expansion and contraction of said joint induces said opposed portions of each said end wall to separate one from the other.

8. A sealing member as set forth in claim 7 wherein two support members are connected to each of said end walls at the midportion thereof and extend to said top and bottom walls for respective connection therewith at locations adjacent to said respective retaining member.

9. A sealing member as set forth in claim 8 wherein said top and bottom walls each include a longitudinally extending fold located substantially along the center line of said gap defined between said retaining members with said folds extending towards one another.

10. A sealing member as set forh in claim 9 further including an X-shaped truss extending between said top and bottom walls intermediate to the connections of said support members therewith and being symmetrically disposed about the center line of said gap defined between said retaining members.

* * * * *